US008024870B1

(12) United States Patent
Ballentine et al.

(10) Patent No.: US 8,024,870 B1
(45) Date of Patent: Sep. 27, 2011

(54) DRYING SYSTEM FOR PERSONAL HYDRATION SYSTEMS

(75) Inventors: Trent Ballentine, Normal, IL (US); Jason Scott Andrews, Indianapolis, IN (US); Dennis Matthew Turner, Moorsville, IN (US)

(73) Assignee: Simple Matter, Inc., Normal, IL (US)

( * ) Notice: Subject to any disclaimer, the term of this patent is extended or adjusted under 35 U.S.C. 154(b) by 398 days.

(21) Appl. No.: 12/167,560

(22) Filed: Jul. 3, 2008

Related U.S. Application Data

(60) Provisional application No. 60/948,563, filed on Jul. 9, 2007.

(51) Int. Cl.
*F26B 25/00* (2006.01)

(52) U.S. Cl. ..... 34/104; 34/201

(58) Field of Classification Search ..... 34/104, 34/201, 202, 218, 241; 415/182.1, 214.1, 415/213.1

See application file for complete search history.

(56) References Cited

U.S. PATENT DOCUMENTS

| | | | | |
|---|---|---|---|---|
| 2,209,054 | A | 7/1940 | Doud et al. | |
| 4,124,049 | A | 11/1978 | Yamaguchi | |
| 4,171,580 | A | 10/1979 | Vabrinskas | |
| 4,526,298 | A | 7/1985 | Boxer et al. | |
| 5,060,833 | A | 10/1991 | Edison et al. | |
| 5,222,308 | A | 6/1993 | Barker et al. | |
| 5,287,636 | A | 2/1994 | Lafleur et al. | |
| 6,098,849 | A | 8/2000 | McInnes | |
| 6,155,781 | A * | 12/2000 | Tsai | 415/206 |
| 6,216,961 | B1 | 4/2001 | Utter et al. | |
| 6,481,642 | B1 | 11/2002 | Louis, Jr. et al. | |
| 6,688,019 | B2 | 2/2004 | Buchweitz | |
| 6,755,047 | B2 | 6/2004 | Kreutzmann et al. | |
| 7,361,164 | B2 * | 4/2008 | Simpson et al. | 604/236 |
| 2002/0074369 | A1 | 6/2002 | Forsman et al. | |
| 2004/0045980 | A1 | 3/2004 | Robins | |
| 2004/0244216 | A1 | 12/2004 | Poole | |
| 2005/0251090 | A1 | 11/2005 | Hoskins | |
| 2007/0261263 | A1 * | 11/2007 | Lee | 34/201 |

OTHER PUBLICATIONS

Kycon, Inc., KLDPX-0207-x-DC Power Jack, Panel Mount drawing, Jan. 18, 2008.
Mabuchi Motor Co. Ltd., RS-385SH—Motor Mounting drawing.

* cited by examiner

*Primary Examiner* — Jiping Lu
(74) *Attorney, Agent, or Firm* — Andrus, Sceales, Starke & Sawall, LLP

(57) ABSTRACT

A drying system for drying a personal hydration system having a fill opening and a supply tube includes a dryer assembly providing a flow of forced air to be introduced into the fill opening of the personal hydration device. The dryer assembly includes seal-forming structure engageable with the fill opening to form a seal between the dryer assembly and the fill opening to enhance the pressurization and inflation of the personal hydration system. The dryer assembly also includes a channel defining a relief valve for permitting exhaust of air flow from the fill opening upon pressurization and inflation of the personal hydration system. The dryer assembly further includes a resilient cam arm for enabling the dryer assembly to sealingly fit variously sized fill openings.

8 Claims, 10 Drawing Sheets

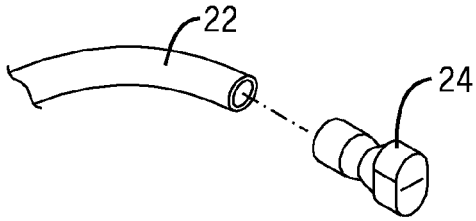
FIG. 5
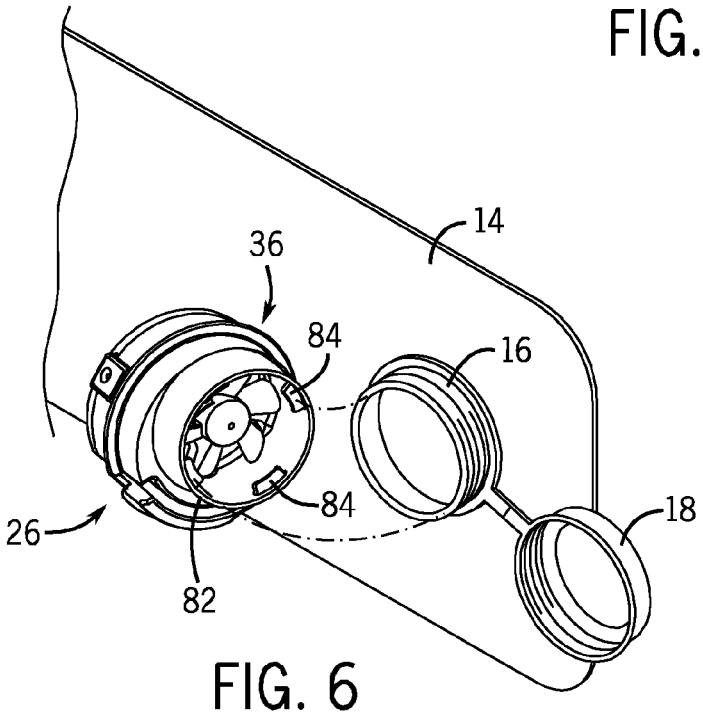
FIG. 6
FIG. 7
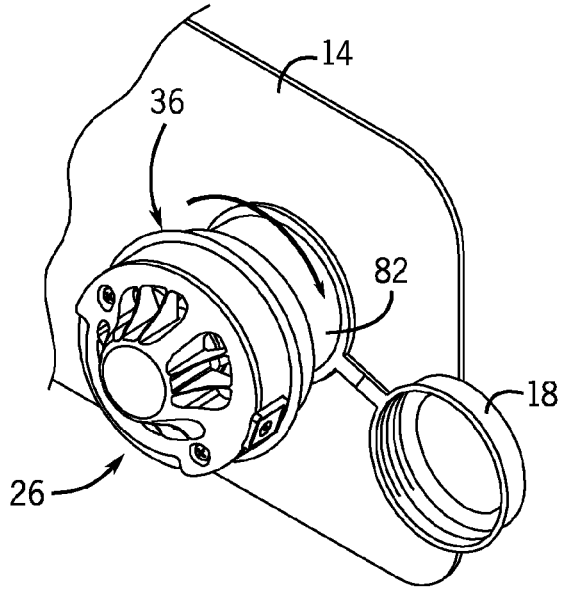

DRYING SYSTEM FOR PERSONAL HYDRATION SYSTEMS

CROSS REFERENCE TO RELATED APPLICATION

This application claims the benefit of U.S. Provisional Patent Application Ser. No. 60/948,563, filed Jul. 9, 2007, which is incorporated herein by reference.

FIELD

The present application relates generally to a drying system for personal hydration systems and, more particularly, pertains to systems and methods for reliably, efficiently and safely drying a bladder and a supply hose of a personal hydration system.

BACKGROUND

Many athletes and others use back-mounted or waist-mounted personal hydration systems to carry water or other drinking liquid with them during strenuous activities. The systems typically include a flexible bag or hydration bladder in which the liquid of choice is contained, and a flexible supply hose running from the bladder to the mouth of a user to allow the user to take in liquids easily. The hydration bladder may be formed with various size fill openings that allow the user to pour water or a desired drink into and out of the bladder, and a removable cap is provided for opening and closing the fill opening. The outermost end of the supply hose is equipped with a valve that prevents air from entering into the system, and selectively enables the dispensing of liquid into the mouth of the user usually upon biting the valve. Such systems are convenient and provide hands-free hydration in lieu of carrying canteens, bottles, cans and other containers.

Once a user has completed activity, the nature of the materials involved in the personal hydration system does not readily allow for drying of the hydration bladder and the supply hose. This allows for retention of the liquid in the bladder for long periods of time, and therefore the possibility for growth of potentially harmful microorganisms, such as bacteria, mold and mildew.

SUMMARY

The present application provides drying systems adapted to dry a personal hydration system having a fill opening and a supply hose. A dryer assembly providing a flow of forced air is adapted to be introduced into the fill opening of the personal hydration system. The dryer assembly includes a seal-forming structure adapted to form a seal with the fill opening of the personal hydration system to enhance the pressurization and inflation of the personal hydration system.

In another example, the dryer assembly includes an internal and external seal-forming structure. The dryer assembly may include a cover having a first retaining structure, and a dryer housing connected to the cover and having a second retaining structure. A motor may be positioned and retained between the first and second retaining structures and connected to a source of power. A fan is connected to a shaft of the motor and is located within the dryer housing. The dryer assembly may include a dryer housing constructed with a generally cylindrical first wall portion, a generally cylindrical second wall portion separated from the first wall portion by a flange and a generally cylindrical third wall portion extending from the second wall portion. The third wall portion is located eccentric to the first and second wall portions. An outer surface of the second wall forms a first seal-forming structure adapted to form a seal with one size fill opening of the bladder. An inner surface of the third wall portion defines a second seal-forming structure adapted to form a seal with another size fill opening of the bladder. The dryer assembly may include a channel defining a relief valve adapted to permit exhaust of air flow from the fill opening upon pressurization and inflation of the personal hydration system. The dryer assembly also may include a resilient cam arm adapted to enable the dryer assembly to sealingly fit variously sized fill openings.

In another example, a hydration bladder has a fill opening and a supply hose. A dryer assembly provides a flow of forced air introduced into the fill opening of the personal hydration system, and is sealed to the fill opening of the bladder.

The dryer assembly may have an external and internal seal-forming structure, either of which is sealed to the fill opening. The dryer assembly may include a dryer housing have a generally cylindrical first wall portion, a generally cylindrical second wall portion separated from the first wall portion by a flange, and a generally cylindrical third wall portion extending from the second wall portion. The second wall portion engages the fill opening to form a seal. An inner surface of the third wall portion is formed with retaining structure that engages the fill opening to form a seal.

In another example, a method of removing moisture from a personal hydration system having a bladder with a fill opening and a supply hose is provided. The method may include the steps of supplying a dryer assembly for providing a flow of forced air; engaging the dryer assembly against the fill opening of the bladder to create a seal between the dryer assembly and the fill opening; and operating the dryer assembly to force air into the bladder and out of the supply hose.

In another example, the method may include the step of providing the dryer assembly with a relief valve enabling air forced into the bladder to exhaust from the fill opening through the relief valve. The method may also include the step of providing the dryer assembly with a resilient cam arm enabling the dryer assembly to sealingly fit various sizes of fill openings. The step of engaging the dryer assembly with the fill opening may include the step of engaging retaining structure on the dryer assembly with threads of the fill opening. The step of engaging the dryer assembly with the fill opening also may include the step of engaging an outer wall portion of the dryer assembly with threads of the fill opening.

BRIEF DESCRIPTION OF THE DRAWINGS

The drawings illustrate the best mode presently contemplated in carrying out the invention.

In the drawings:

FIGS. 5-9 show diagrammatic views of the method of using the drying system with one type of personal hydration system;

DETAILED DESCRIPTION OF THE DRAWINGS

Figure 1:
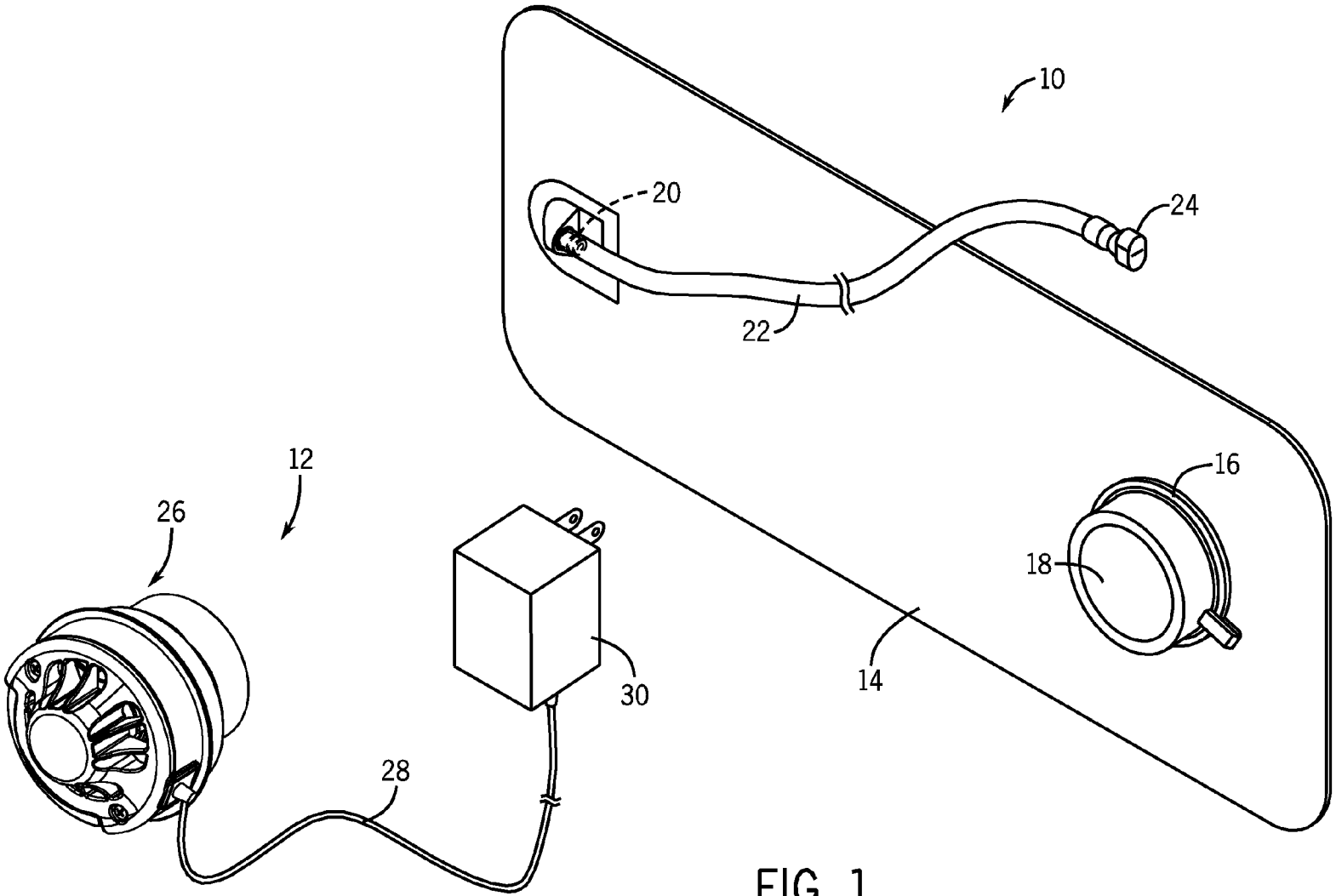
FIG. 1 is a perspective view of a personal hydration system and a drying system embodying the present invention.

Referring now to the drawings, FIG. 1 illustrates a personal hydration system 10 for storing liquid (such as water, sport drinks, juices, etc.), and a drying system 12 for eliminating moisture from a drained or emptied system 10. In the example shown, the drying system 12 is designed to provide an enhanced drying which will prevent the possibility for growth of harmful bacteria, mold or mildew in the personal hydration system 10.

Personal hydration system 10 includes a flexible and expandable bladder 14 which is typically housed in a pack that is conveniently worn on the back or waist of a user as is well known. The bladder 14 may vary in size and shape depending on the volume of liquid to be carried by the user and the shape of the pack into which the bladder 14 is stored. The bladder 14 includes a threaded or non-threaded neck 16 defining a fill opening with a cap 18 which may be opened and closed to empty, fill or clean the bladder 14. Bladder 14 also includes an outlet opening 20 onto which one end of a flexible supply hose 22 is mounted. The supply hose 22 defines an elongated drinking tube to enable drink liquid to be withdrawn from the bladder 14. The other end of the supply hose 22 is provided with a valve in the form of a bite or mouth-actuated mouthpiece 24. The mouthpiece 24 is selectively deformed from a closed position in which liquid is prevented from being dispensed to a dispensing position in which the user may draw liquid from the bladder when the user compresses the mouthpiece 24 with one's teeth or lips. Drying system 12 includes a dryer assembly 26 connected to a wire 28 of a 110/220 to 12 volt power converter 30 that plugs into a wall outlet, or is otherwise connected to a source of electrical power. The dryer assembly 26 could be alternatively powered by a solar panel, battery packs or electrical generator, if desired. In the preferred embodiment, the dryer assembly 26 is electrically powered, but it should be understood that the dryer assembly 26 may contemplate other embodiments that provide a flow of forced air for drying the personal hydration system 10.

Figure 2:
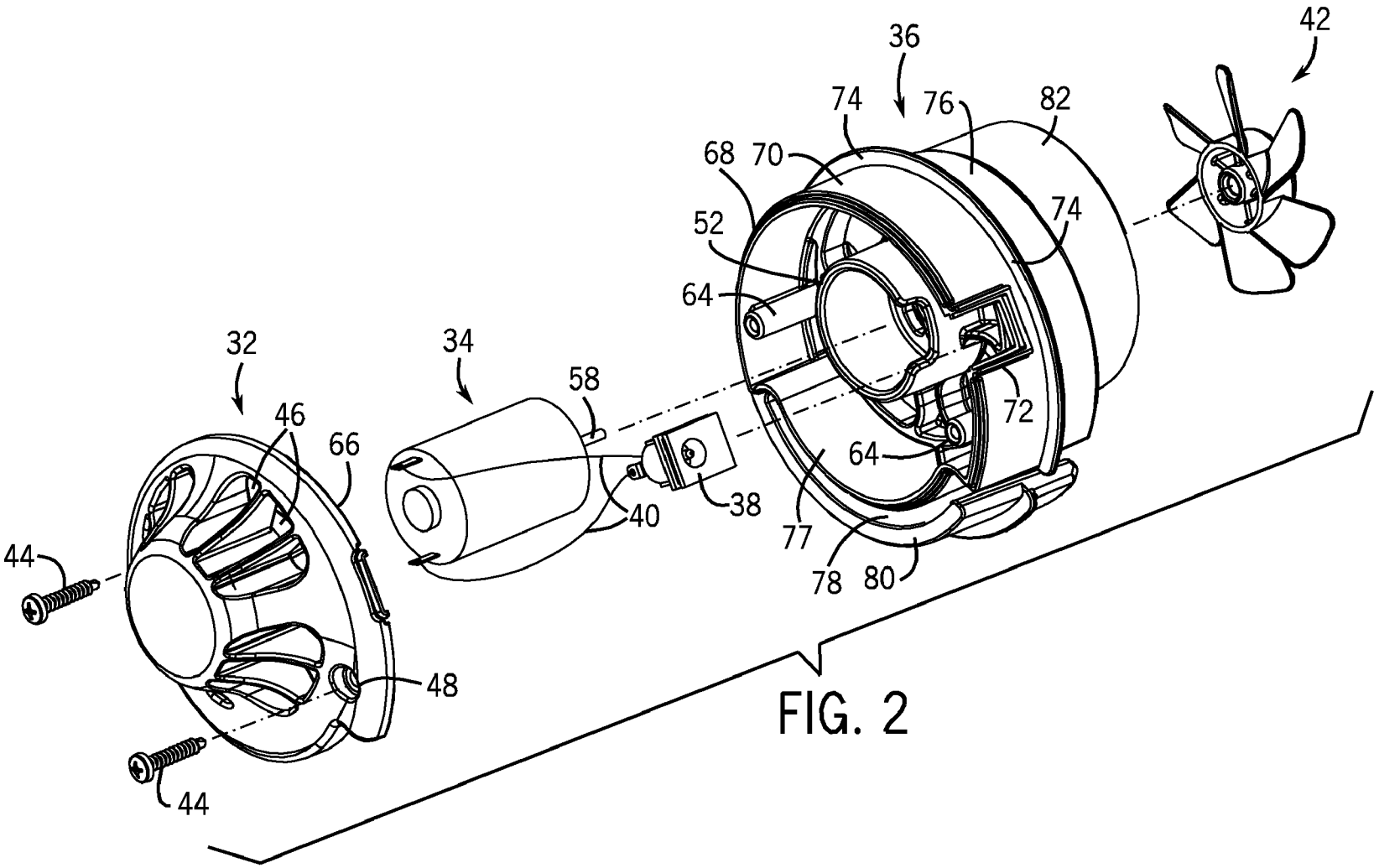
FIG. 2 is an exploded view of the dryer assembly used in the drying system.

Referring now to FIG. 2, the dryer assembly 26 is comprised of a dryer housing cover 32, an electric motor 34, a dryer housing 36 provided with a DC power jack 38 connected by wires 40 to motor 34 and a fan 42, the assembly being held together by a pair of screws 44. Cover 32, the housing 36 and fan 42 are preferably injection molded from plastic.

Cover 32 is formed with a series of intake openings 46 and a pair of spaced apart fastener openings 48 for receiving the screws 44. As seen best in FIG. 10, interior portions of cover 42 and dryer housing 36 are provided with upper and lower generally cylindrical cups 50 and 52, respectively, for retaining motor 34 therein. The bottom of cup 52 has a central recess 54 (FIG. 4) for receiving an end 56 of the motor 34 having a shaft 58 which is press fit via a bearing 60 in the fan 42. The fan 42 is driven by motor 34 and is designed to rotate within a cylindrical chamber 62 within the dryer housing 36. The interior of dryer housing 36 also includes a pair of bosses 64 into which the screws 44 are self-threaded. Cover 32 and dryer housing 36 have mating peripheral surfaces 66, 68, respectively, which are held together by screws 44.

Figure 3:
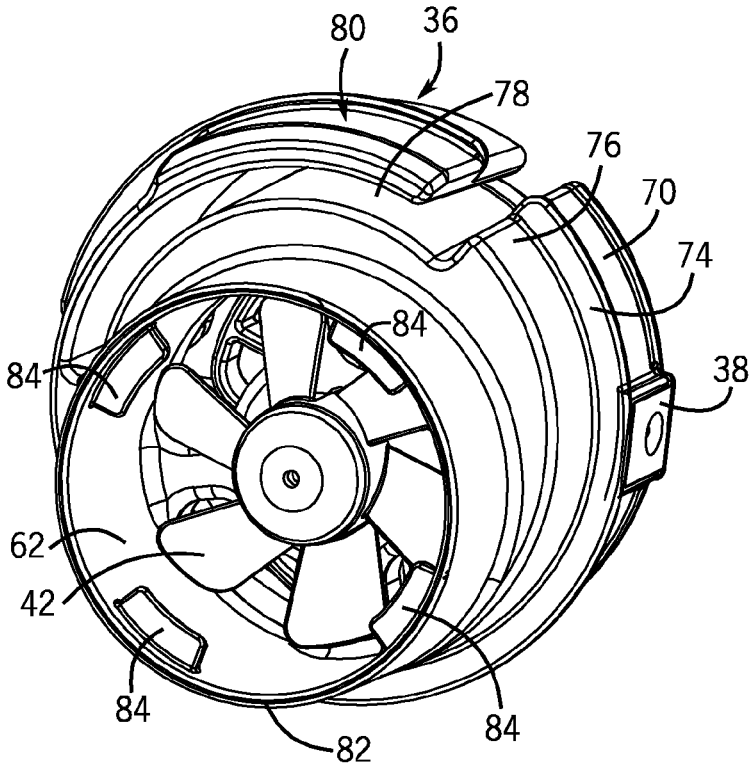
FIG. 3 is a top perspective view of the assembled dryer assembly.
Figure 4:
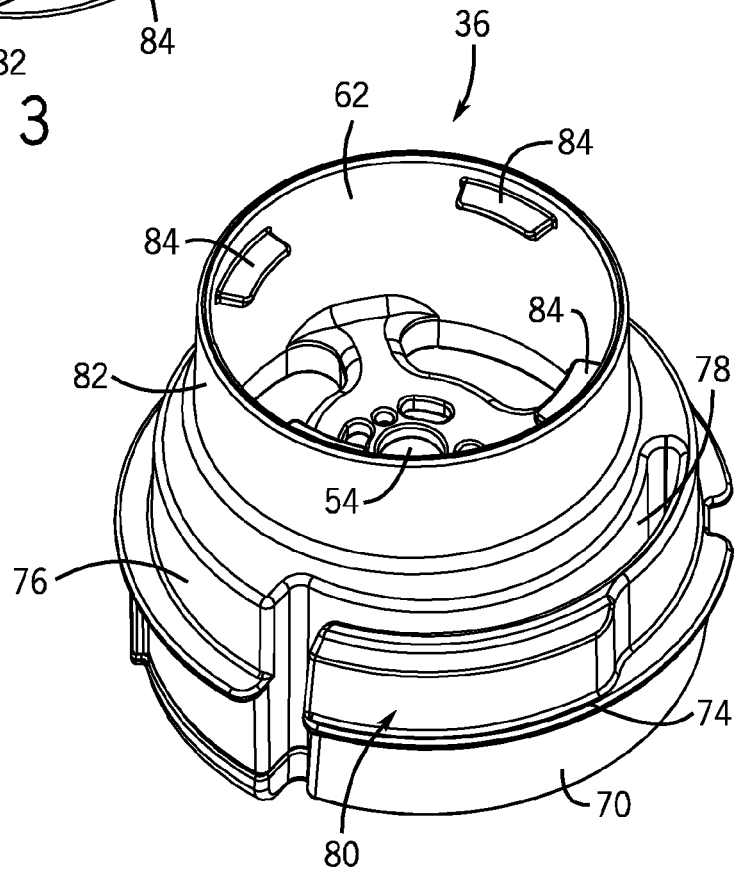
FIG. 4 is a perspective view of the dryer housing of the dryer assembly with the fan removed for clarity.
Figure 10:
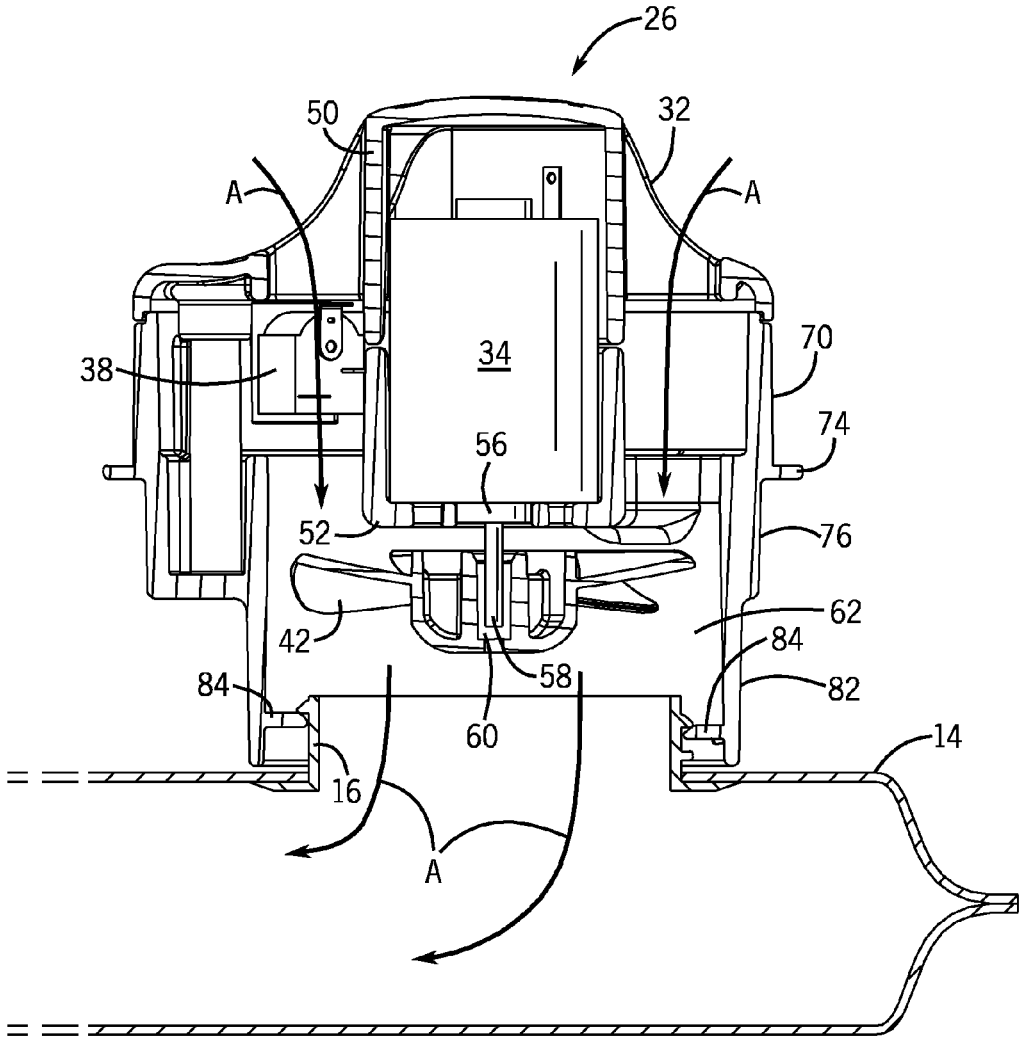
FIG. 10 is a sectional view taken on line 10-10 of FIG. 9.
Figure 11:
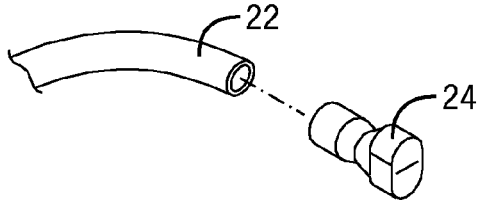
FIGS. 11-14 show diagrammatic views of the method of using the dryer system with another type of personal hydration system.
Figure 12:
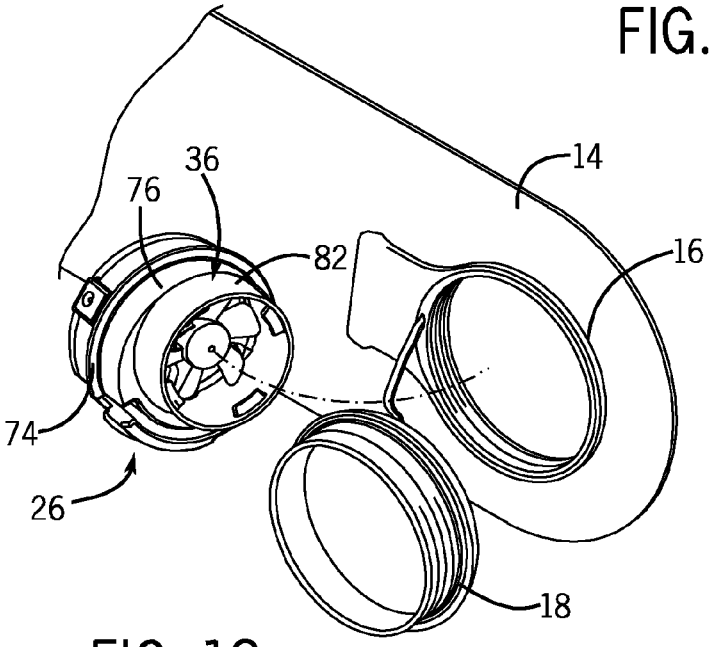
Figure 13:
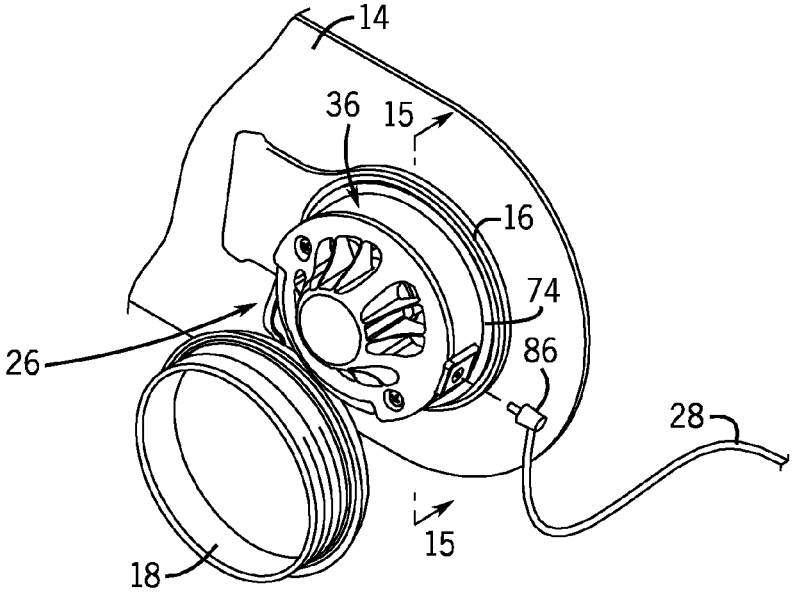
Figure 15:
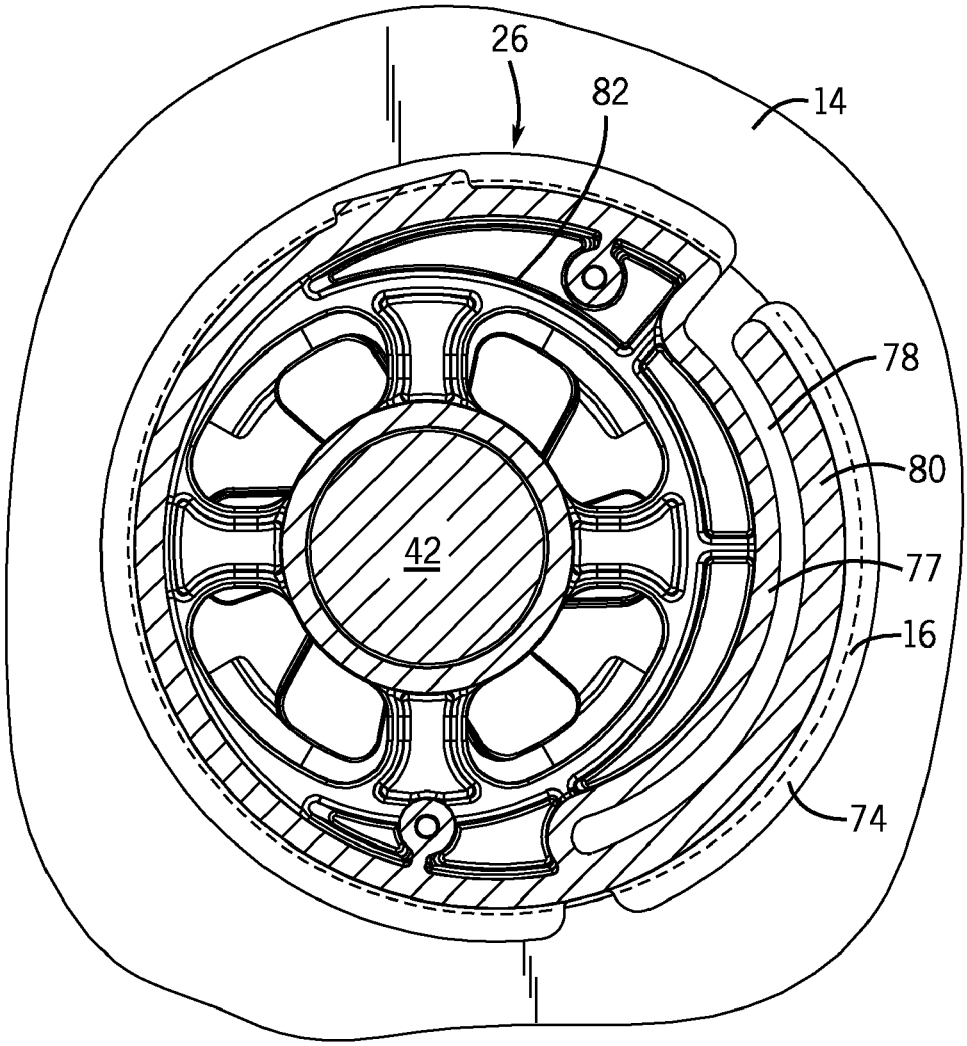
FIG. 15 is a sectional view taken on line 15-15 of FIG. 13.

Still referring to FIGS. 2 and 10, as well as FIGS. 3 and 4, the dryer housing 36 is configured with a generally cylindrical upper wall portion 70 that is cut out at 72 to seat the DC power jack 38. The wall portion 70 includes a flange 74 that extends substantially around the entire periphery thereof. The dryer housing 36 further has a generally cylindrical intermediate wall portion 76 which depends downwardly from flange 74 as depicted in FIG. 10. A portion of the dryer housing 36 includes an inner wall 77 offset inwardly from wall portions 70 and 76 to form a channel 78 that serves as a relief valve. The relief valve 78 allows the bladder 14 to be inflated, but prevents over inflation of the bladder 14 and allows moisture-filled air to leave the bladder 14 through both the relief valve 78 and the supply hose 22. The curved segments of the wall portions 70 and 76 lying coextensively along the length of channel 78 form a resilient cam arm 80 that enables the dryer assembly 26 to be used with variously sized fill opening necks 16 of bladder 14. Squeezing the cam arm 80 allows a user to reduce the diameter of the dryer housing 36 so that the dryer housing will fit into the particular fill opening neck 16. The dryer housing 36 also has a generally cylindrical lower wall portion 82 which may be slightly downwardly tapered to accommodate other sized fill openings 16. The lower wall portion 82 forms the chamber 62 in which the fan 42 rotates. As best seen in FIG. 15, the lower wall portion 82 is located eccentrically relative to the upper and intermediate wall portions 70 and 76, respectively. A series of four spaced apart tabs 84 extend inwardly from an inner surface of the lower wall portion 82 and are engageable with certain sized threaded fill opening necks 16 on the bladder 14. Although not shown, the invention contemplates retaining structure other than tabs 4 by substituting a series of tapering walls on the inside surface of the lower wall portion 82 which provide a press fit seal engagement with the fill opening neck 16.

The intermediate wall portion 76 and the tabs 84 define external and internal seal-forming structure of the dryer assembly 26 which are variously engageable with differently sized fill opening necks 16 to form a seal between the dryer assembly 26 and the fill opening neck 16 that will enhance pressurization and inflation of the hydration bladder 14 during a drying operation.

Figure 8:
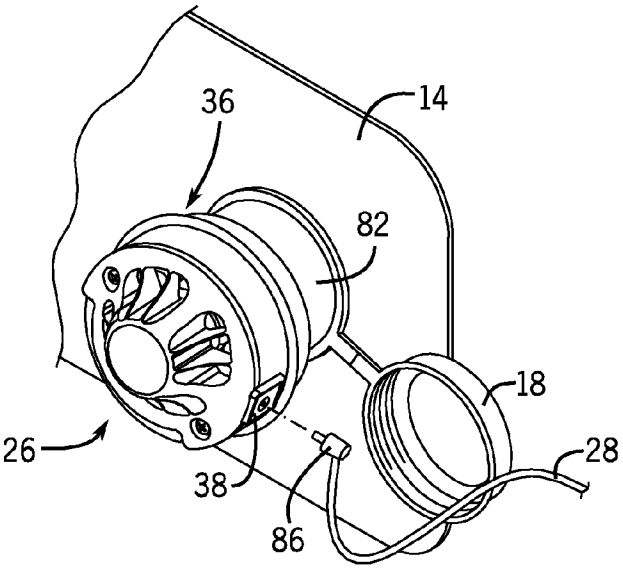
Figure 9:
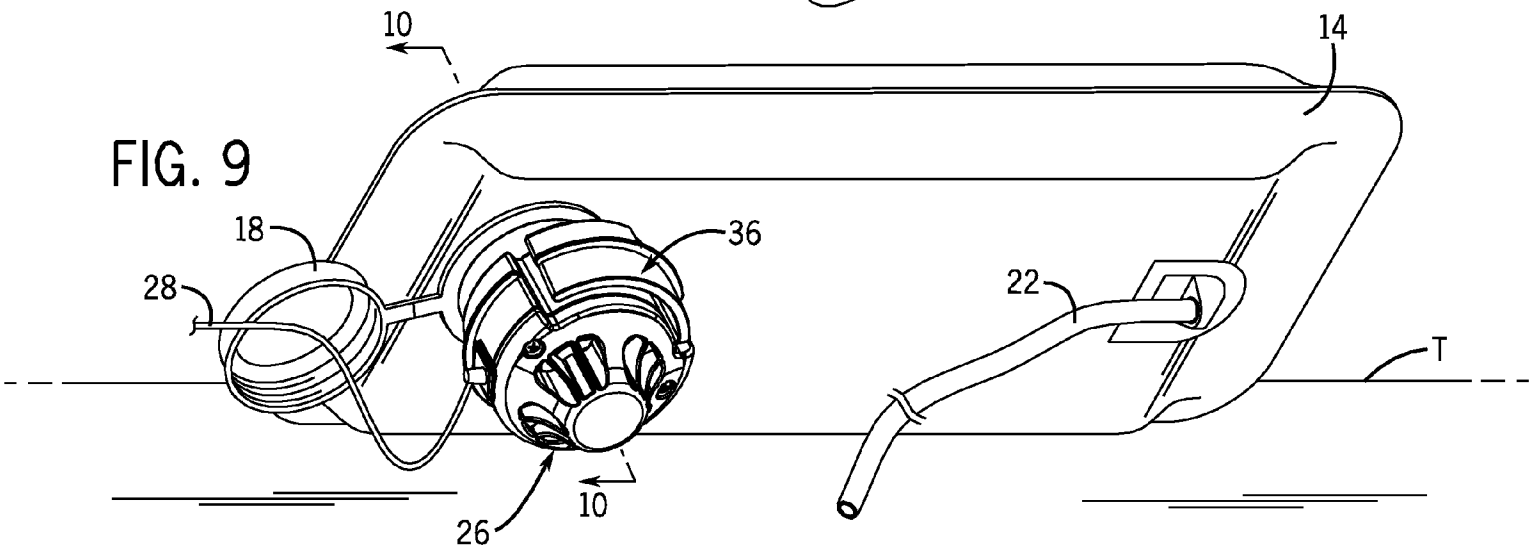

FIGS. 5-10 illustrate a method for using the dryer system 12 to dry a personal hydration system 10 having a relatively small threaded fill opening neck 16. A user first removes the mouthpiece 24 (FIG. 5) and drains liquid from the bladder 14 and the supply hose 22. With the cap 18 on bladder 14 removed, the tabs 84 on lower wall portion 82 of the dryer housing 36 are engaged with threads of fill opening neck 16 (FIG. 6). The dryer assembly 26 is then turned in a clockwise direction (FIG. 7) to lockingly attach the dryer assembly 26 to the fill opening neck 16 and form a seal therebetween. Electrical power is supplied to the motor 34 in the dryer assembly 26 by inserting a plug 86 on the end of wire 28 into the jack 38 with the converter 30 plugged into an electrical wall outlet (FIG. 8). The dryer assembly 26 is then placed on a table T or other horizontal support surface with the bladder 14 facing up (FIG. 9) so that the motor driven fan 42 will force air through the fill opening neck 16 until the bladder 14 and the supply hose 22 are fully dried. FIG. 10 uses arrows A to depict the air flow provided during a drying operation.

Because of the sealing relationship between the fill opening neck 16 and the dryer assembly 26, the bladder 14 is pressurized and inflated in a faster, more efficient method than in previous drying methods to exhaust moistened air out of the supply hose 22. The enhanced inflation caused by the seal formation ensures that air circulates throughout the entire bladder 14 and the supply hose 22 so that all moisture can evaporate. The air relief valve formed by channel 78 allows the bladder 14 to be fully inflated, but prevents overinflation of the bladder 14 and allows moisture-laden air to leave the bladder 14 through both the supply hose 22 and the relief valve 78. The drying system 12 is particularly effective in providing forced air into the corners of the bladder 14 so as to prevent the growth of mold, mildew and other bacteria.

Figure 14:
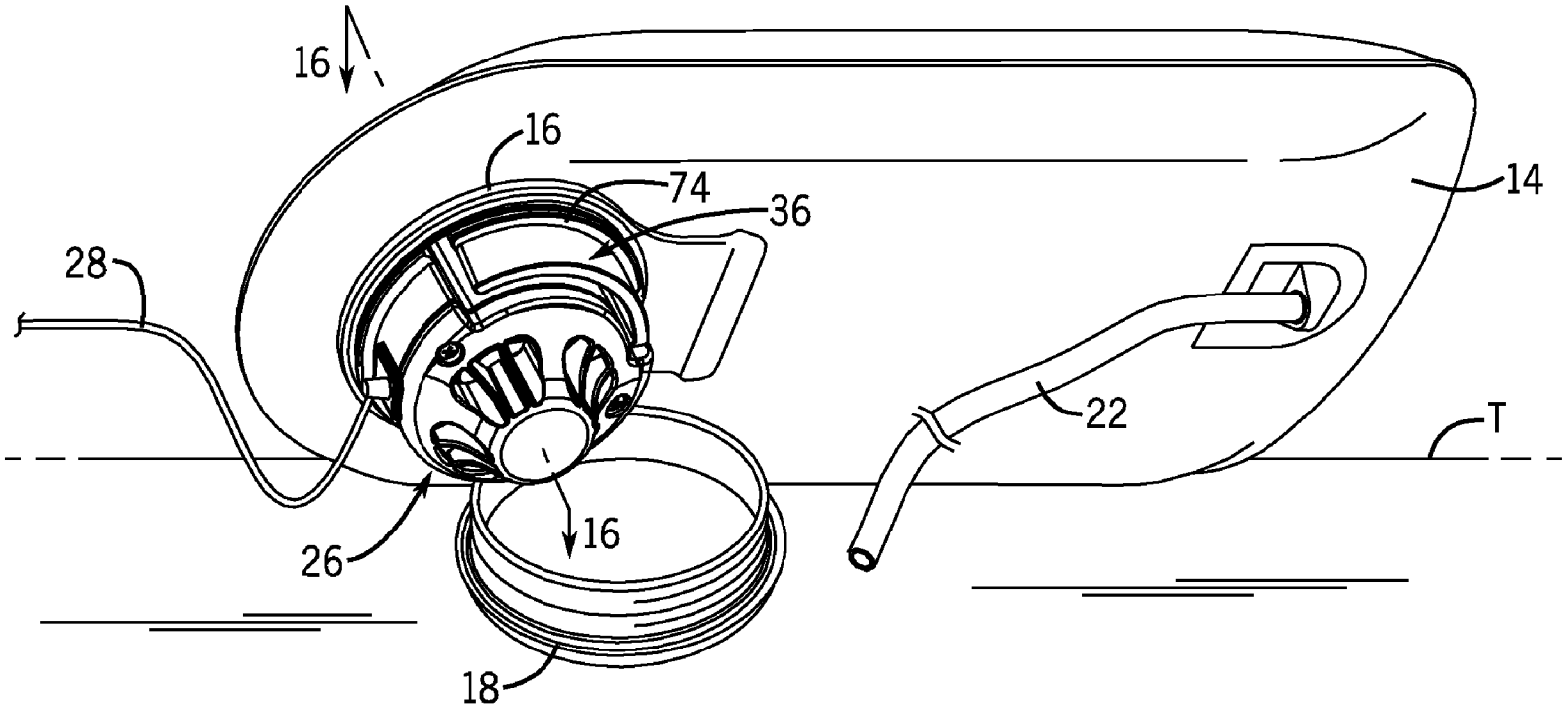
Figure 16:
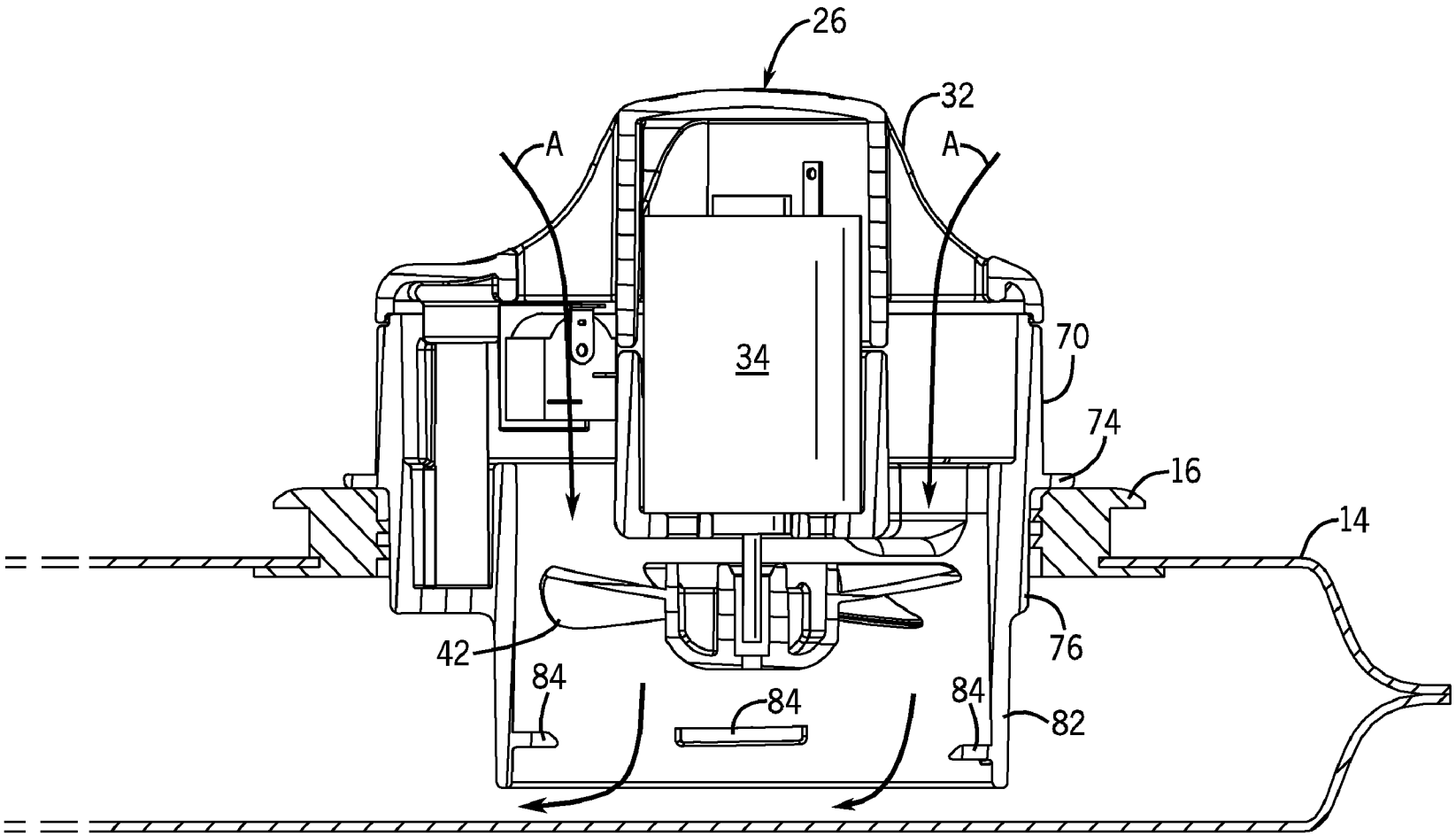
FIG. 16 is a sectional view taken on line 16-16 of FIG. 14.

FIGS. 11-16 illustrate the method of using the drying system 12 to dry a personal hydration system 10 having a relatively larger fill opening neck 16 than shown in FIGS. 5-9. After the mouthpiece 24 is removed (FIG. 11), the intermediate and lower wall portions 76 and 82, respectively, are inserted into the threaded fill opening neck 16 until the flange 74 contacts the top surface of the fill opening neck 16 (FIG. 12, 13) with the wall portion 76 engaging the threaded area of the fill opening neck 16 to form a seal. Electric power is then supplied to the motor 34 in the dryer assembly 26 with the bladder 14 facing up so that forced air will dry the bladder 14 (FIG. 14). FIG. 15 shows that the relief valve 78 is in constant communication with the interior of bladder 14, while sealing engagement occurs between the dryer assembly 26 and the fill opening neck 16. FIG. 16 further shows a sealing engagement between the intermediate wall portion 76 and the fill opening neck 16 as air is forced into the bladder 14. Flange 74 limits the insertion of dryer assembly 26 into fill opening neck 16 and also engages in sealing the dryer assembly 26 to the fill opening neck 16.

It should be appreciated that the dryer assembly 26 may be sealingly engaged with other fill opening necks 16 by squeezing the cam arm 80 allowing the dryer assembly 26 to be engaged with neck 16. Once cam arm 80 is released, the dryer assembly 26 expands providing the necessary seal with the neck 16 of the bladder 14.

It should also be understood that a bladder 14 may be dried by the drying system 12 while the bladder 14 remains in a waist or back-mounted pack. Although not shown, the drying system 12 may have an alternate use for drying shoes and boots after a hike or ride. Such a drying system is advantageous because there is no heat to shrink leather or synthetic materials of the footwear. The drying system 12 has been found to work well on drying new bladders 14 to evaporate solvents left over from the manufacturing process. The drying system 12 is applicable to a variety of personal hydration systems, such as those worn by users in a variety of sporting, recreational, hunting, industrial, military, and law enforcement applications.

The examples discussed above thus provide preventive maintenance and enhanced drying of a hydration bladder and supply hose, wherein the dryer assembly engages with the fill opening neck to form a seal enabling pressurization and inflation of the bladder forcing air to circulate and exhaust out the supply hose and the relief valve. The enhanced drying functions to eliminate the formation of harmful mold or mildew in the hydration bladder and supply hose thereby eliminating the need for any cleaning brushes and cleaning tablets. The dryer housing is configured to sealingly fit different brands of bladders with different diameters and both threaded and non-threaded necks.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

What is claimed is:

1. A drying system for drying a first personal hydration system having a first fill opening and a second personal hydration system having a second, larger fill opening, the drying system comprising:

a housing;

an air intake;

an air outlet;

a fan disposed in the housing and forcing air from upstream at the air intake to downstream at the air outlet;

wherein the housing comprises a first wall portion sized to engage with the first fill opening of the first personal hydration system and a second wall portion located upstream of the first wall portion and sized larger than the first wall portion so as to engage with the second, larger fill opening of the second personal hydration system; and a seal-forming structure on the second wall portion sealing with the second fill opening;

wherein the seal-forming structure comprises a relief valve that prevents over-inflation of the second personal hydration system.

2. A drying system according to claim 1, wherein the first wall portion is eccentrically located relative to the second wall portion from upstream to downstream.

3. A drying system according to claim 2, wherein the first wall portion is circular in cross section and wherein the second wall portion is circular in cross section.

4. A drying system for drying a first personal hydration system having a first fill opening and a second personal hydration system having a second, larger fill opening, the drying system comprising:

a housing;

an air intake;

an air outlet;

a fan disposed in the housing and forcing air from upstream at the air intake to downstream at the air outlet;

wherein the housing comprises a first wall portion sized to engage with the first fill opening of the first personal hydration system and a second wall portion located upstream of the first wall portion and sized larger than the first wall portion so as to engage with the second, larger fill opening of the second personal hydration system; and a seal-forming structure on the second wall portion sealing with the second fill opening;

wherein the seal-forming structure comprises a resilient cam arm;

wherein the housing comprises an inner wall portion, wherein the second wall portion lies coextensively with the resilient cam arm so as to define a channel between the resilient cam arm and the inner wall portion.

5. A drying system according to claim 4, wherein the resilient cam arm and inner wall portion form a relief valve that prevents over-inflation of the second personal hydration system.

6. A drying system according to claim 4, comprising an outwardly directed flange located upstream of the second wall portion for engaging with an external perimeter surface of the second, larger fill opening.

7. A drying system according to claim 6, comprising a third wall portion, wherein the outwardly directed flange is disposed between the third wall portion and second wall portion from upstream to downstream.

8. A drying system for drying a first personal hydration system having a first fill opening and a second personal hydration system having a second, larger fill opening, the drying system comprising:

a housing;

an air intake;

an air outlet;

a fan disposed in the housing and forcing air from upstream at the air intake to downstream at the air outlet;

wherein the housing comprises a first wall portion sized to engage with the first fill opening of the first personal hydration system;

wherein the housing comprises a second wall portion located upstream of the first wall portion and offset outwardly relative to the first wall portion so as to engage with the fill opening of the second personal hydration system;

an internal seal-forming structure on the first wall portion sealing with the first fill opening; and an external seal-forming structure on the second wall portion sealing with the second fill opening, the external seal-forming structure comprising a resilient cam arm that can be flexed inwardly to accommodate insertion of the second wall portion into the second, larger fill opening and that flexes outwardly to seal with the second, larger fill opening.

* * * * *